US008798514B2

(12) United States Patent
Tanaka et al.

(10) Patent No.: US 8,798,514 B2
(45) Date of Patent: Aug. 5, 2014

(54) IMAGE FIXING APPRATUS FOR FIXING A TONER IMAGE ON A RECORDING MATERIAL BY HEATING THE TONER IMAGE WHILE FEEDING THE RECORDING MATERIAL THROUGH A NIP

(75) Inventors: Masashi Tanaka, Kawasaki (JP); Kohei Okayasu, Mishima (JP); Takanori Watanabe, Kawasaki (JP); Keisuke Fujita, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/484,960

(22) Filed: May 31, 2012

(65) Prior Publication Data

US 2012/0308279 A1 Dec. 6, 2012

(30) Foreign Application Priority Data

Jun. 3, 2011 (JP) ..... 2011-125126

(51) Int. Cl.
*G03G 15/20* (2006.01)

(52) U.S. Cl.
USPC ..... 399/329

(58) Field of Classification Search
USPC ..... 399/329, 328, 320
See application file for complete search history.

(56) References Cited

U.S. PATENT DOCUMENTS 5,257,078 A * 10/1993 Kuroda ..... 399/329
5,525,775 A 6/1996 Setoriyama et al.
7,650,105 B2 1/2010 Ogawa et al.
2008/0292374 A1* 11/2008 Hiraoka et al. ..... 399/328
2010/0135706 A1 6/2010 Miki et al.
2010/0260523 A1 10/2010 Nishida et al.
2011/0236084 A1 9/2011 Nishida et al.
2011/0305474 A1 12/2011 Tanaka et al.
2012/0099882 A1 4/2012 Tanaka
2012/0148304 A1 6/2012 Sugaya et al.
2012/0155938 A1 6/2012 Tanaka et al.

FOREIGN PATENT DOCUMENTS

JP 4-44075 A 2/1992

* cited by examiner

*Primary Examiner* — Billy Lactaoen

(74) *Attorney, Agent, or Firm* — Fitzpatrick, Cella, Harper & Scinto

(57) ABSTRACT

Image fixing apparatus for fixing a toner image through a nip, the apparatus including a cylindrical film; a nip forming member contacting an inner surface of the film; a pressing rotatable member forming the nip in cooperation with the nip forming member with the film interposed therebetween; and a regulating member for regulating movement of the film in a direction of a generatrix of the film, wherein the regulating member has an opposing surface opposing an edge of an end portion of the film with respect to the direction of the generatrix, and the opposing surface has a regulation region for regulating the edge of the film when the film is driven and moves in the generatrix direction, wherein the regulation region is narrower in a downstream side of a center portion of the nip than in an upstream side thereof with respect to a sheet feeding direction.

11 Claims, 9 Drawing Sheets

(a)

(b)

IMAGE FIXING APPRATUS FOR FIXING A TONER IMAGE ON A RECORDING MATERIAL BY HEATING THE TONER IMAGE WHILE FEEDING THE RECORDING MATERIAL THROUGH A NIP

FIELD OF THE INVENTION AND RELATED ART

The present invention relates to an image fixing apparatus for use with an image forming apparatus such as a copying machine or a laser beam printer of an electrophotographic type.

As for an image heating apparatus for use with an electrophotographic type apparatus, a heating roller type and a film heating type apparatus are known. The film heating type image heating apparatus uses a film having a small thermal capacity as a fixing member, and therefore, the time required to raise a temperature of the fixing member up to a predetermined level can be short as compared with a heat roller type image heating apparatus. Since the time is short, it is unnecessary to warm the fixing member when a stand-by period, and therefore, the electric energy consumption can be saved.

As for the material of a fixing film used in the image heating apparatus of the film heating type, a metal material such as SUS or nickel, and a heat resistive resin material such as polyimide resin material are used. The metal material has a higher strength than the resin material, and therefore, it may be thin, and a thermal conductivity is higher, and therefore, a speed-up and/or long lifetime can be accomplished. On the other hand, the resin material has a smaller density and thermal capacity, and therefore, and is easy to heat, as compared with the metal material. In the case of the resin material, a thin film can be molded by paint molding, and therefore, the molding cost is low.

When the fixing film is used in the film heating type, the fixing film may shift in an axial direction, that is, perpendicular to the direction of traveling of the fixing film, and it is very difficult to control the shifting with high accuracy. Japanese Laid-open Patent Application Hei 04-044075 discloses that the fixing film is loosely fitted to reduce the shifting force to the fixing film, and an edge of the fixing film 112 is limited by a regulation surface of a regulating member (flange).

In such a case, however, when the shifting force is large, the end portion of the fixing film 112 may be folded or cracked (edge damage). If this occurs, a fixed image provided by the image heating apparatus may be deteriorated, the traveling of the fixing film may become improper, and/or the durability of the fixing film may be deteriorated. In order to avoid this, the film thickness of the fixing film is increased, and/or the film material may be added with additive to raise the strength of the film.

However, in such a conventional film heating type image heating apparatus, a sheet jamming may occur due to a disorder of the image forming apparatus, a recording material feeding defect of the heating apparatus, emergency stop by the user and/or power failure, during the sheet being fed. If this occurs, the jammed sheet has to be removed if it remains in the image heating apparatus, and the film edge damage may occur.

More particularly, if the user pulls the jammed sheet obliquely with respect to the recording material feeding direction to remove the jammed sheet, the fixing film may receive a shifting force which is larger than that during the normal rotation. In the case that the fixing film 112 receives such a large shifting force during the jam clearance operation, the edge of the fixing film 112 hits the regulation surface of the flange with the result of edge damage of the film. If the film thickness is further increased in an attempt to avoid the edge damage of the film, the heat transfer to the recording material from the heater is deteriorated, with the result of poorer toner fixing property onto the recording material, that is, the improper fixing.

SUMMARY OF THE INVENTION

Accordingly, it is a principal object of the present invention to provide an image heating apparatus in which the damage of the end portion of the endless belt even in the case of occurrence of a large shifting force to the endless belt (in the normal printing operation or jam clearance operation can be suppressed, without increasing the thickness of the endless belt.

According to an aspect of the present invention, there is provided an image fixing apparatus for fixing a toner image on a recording material by heating the toner image while feeding the recording material through a nip, said apparatus comprising a cylindrical film; a nip forming member contacting an inner surface of said film; a pressing rotatable member forming the nip in cooperation with the nip forming member with said film interposed therebetween; and a regulating member for regulating movement of said film in a direction of a generatrix of said film, wherein said regulating member has an opposing surface opposing an edge of an end portion of said film with respect to the direction of the generatrix, and the opposing surface has a regulation region for regulating the edge of said film when said film is driven and moves in the generatrix direction, wherein the regulation region is narrower in a downstream side of a center portion of the nip than in an upstream side thereof with respect to a feeding direction of the recording material.

According to the present invention, the damage of the end portion of the endless belt even in the case of occurrence of a large shifting force to the endless belt (in the normal printing operation or jam clearance operation can be suppressed, without increasing the thickness of the endless belt.

These and other objects, features and advantages of the present invention will become more apparent upon a consideration of the following description of the preferred embodiments of the present invention taken in conjunction with the accompanying drawings.

DESCRIPTION OF THE EMBODIMENTS (Image Forming Apparatus)

Figure 10:
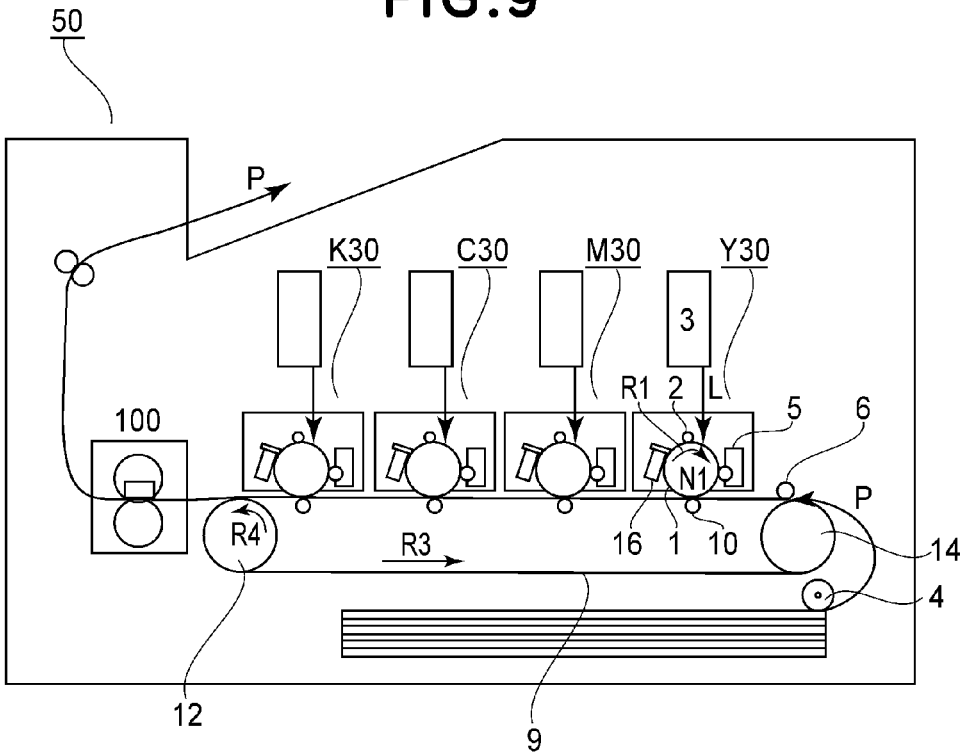
FIG. 10 is a general arrangement of an image forming apparatus incorporating an image heating apparatus according to the present invention.

Referring first to FIG. 10, there is shown an example of an image forming apparatus including an image heating apparatus according to this embodiment. In the image forming apparatus 50, yellow, magenta, cyan and black toner images are sequentially transferred onto a recording material P carried on a recording material feeding belt 9 to form one image. Around a peripheral surface of a photosensitive drum 1 (image bearing member), there are provided a charger 2, an exposure device 3 for projecting a laser beam onto the photosensitive drum 1, a developing device 5, a transfer roller 10 and a photosensitive drum cleaner 16, in this order along a rotational moving direction (arrow R1).

In operation, the surface of the photosensitive drum 1 is charged to the negative polarity by the charger 2. The charged photosensitive drum 1 is exposed to the exposure by the exposure means 3 so that an electrostatic latent image is formed (a surface potential rises in the exposed portions). In this embodiment, the toner for each color is charged to the negative polarity, and the developing device 5 containing yellow toner (first color) deposits the negative toner only on the electrostatic latent image portion of the photosensitive drum 1, so that a yellow toner image is formed on the photosensitive drum 1.

On the other hand, the recording material feeding belt 9 is supported by two supporting shafts (a driving roller 12 and a tension roller 14) and is rotated in the direction of an arrow R3 by the driving roller 12 rotating in the direction of an arrow R4 in the Figure. The recording material P is sheet fed by sheet feeding rollers 4, and is charged by an attraction roller 6 supplied with a positive polarity bias voltage to be electrostatically attracted on the recording material feeding belt 9.

When the recording material P is fed into a transfer nip N, the transfer roller 10 rotated by the recording material feeding belt 9 is supplied with a transfer bias voltage of the positive polarity which is opposite the polarity of the toner from a voltage source (unshown). Then, a yellow toner image is transferred from the photosensitive drum 1 onto the recording material P in the transfer nip N. The photosensitive drum 1 after the transfer is cleaned by the photosensitive drum cleaner 16 including an elastic blade so that untransferred toner is removed from the surface of the photosensitive drum 1.

The series of image forming process operations including the charging, the exposure, the development, the transfer and the cleaning is carries out sequentially by the other developing cartridges for a second color magenta M30, a third color cyan C30 and a fourth color black K30, so that a toner image of the four colors is formed on the recording material P on the recording material feeding belt 9. The recording material P carrying the four color toner image is fed to an image heating apparatus 100, and is nipped and fed by a nip, during which the toner image is heated and fixed on the surface of the recording material P.

(Image Heating Apparatus)

Figure 2:
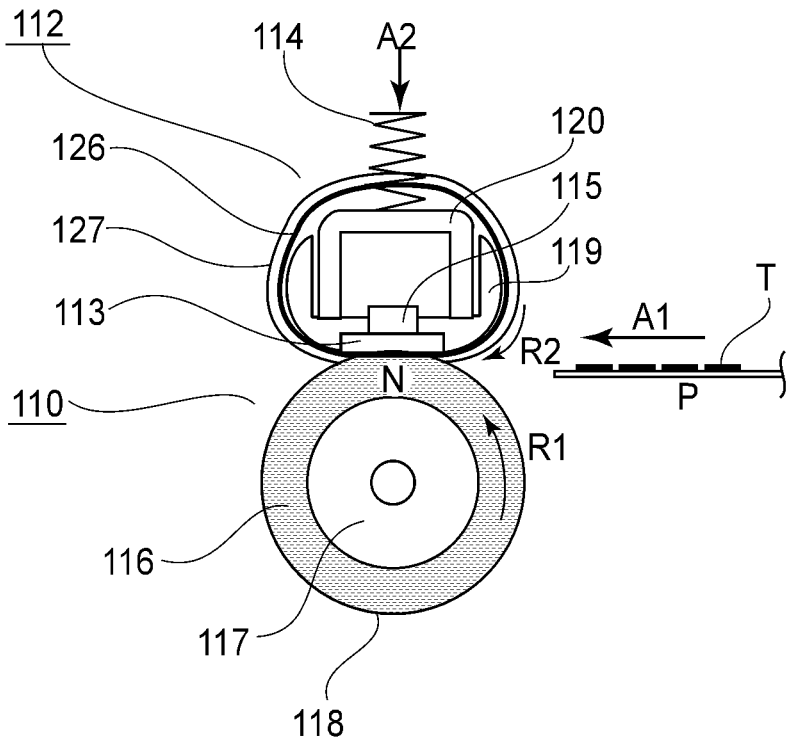
FIG. 2 is a schematic sectional view of an image heating apparatus according to the embodiment of the present invention.

The image heating apparatus 100 of this embodiment will be described. The image heating apparatus 100 of this embodiment is a film heating type image heating apparatus with which rising time is reduced, and the electric energy consumption is reduced. FIG. 2 is a sectional view of the image heating apparatus 100 of this embodiment. In FIG. 2, a fixing film 112 (rotatable member) is a rotatable flexible endless belt, which encloses a heater 113 (heating member). The heater 113 heats the fixing film 112 from the inside.

The heater 113 constitutes a back-up member for press-contacting the fixing film 112 from the inside in cooperation with the heater holder 119 as a holding member. A nip N for pressing and heating the recording material is formed by the back-up member and a pressing roller 110 (pressing rotatable member) opposing thereto through a fixing film therebetween. The pressing roller 110 is driven by a driving source by which the fixing film 112 is rotated.

The heat is conducted from the heater 113 to the pressing roller 110 through the fixing film 112 in the fixing nip N, and the pressing roller 110 is also heated. When the recording material P having the unfixed toner image T is feeding to the fixing nip in the direction of an arrow A1 in the Figure by feeding means (unshown), the heat is transferred from the fixing film 112 and the pressing roller 110 to the unfixed toner image T and the recording material P, so that the toner image T is fixed on the recording material P.

(Fixing Film)

In this embodiment, the cylindrical fixing film 112 is heated from the inside by the heater 113 (heating member) held by the heater holder 119. The material of the heater holder 119 preferably has a low thermal capacity so as not to deprive the heat of the heater 113, and in this embodiment, it is liquid crystal polymer (LCP) as a heat resistive resin material. The heater holder 119 is supported by a stay 120 made of steel for enough strength, at the side opposite the heater 113.

The stay 120 is pressed by an urging spring 114 from the opposite longitudinal end portions with a force of 147 N in the direction of an arrow A2 in the Figure. The heater 113 is pressed against the pressing roller 110 through the fixing film 112 to form the fixing nip N having a width 7.5 mm. The fixing film 112 is rotated in the direction of an arrow R2 by the force received in the fixing nip N by the rotation of the pressing roller 110 in the direction of arrow R1 in the Figure. In this embodiment, the fixing film 112 has an outer diameter of 20 mm, and has a multi-layer structure.

The layer structure of the fixing film 112 includes a base layer 126 for keeping a film strength, and a parting layer 127 for reducing contamination deposition onto the surface. The material of the base layer 126 desirably has a heat resistive because it is subjected to heat from the heater 113, and in addition, enough strength because it slides on the heater 113. Therefore, it may be a metal such as SUS (Stainless Used Steel), nickel or the like, or a heat resistive resin material such as polyimide. The metal has a higher strength than the resin material, and has a high thermal conductivity, and therefore, the heat can be efficiently transferred from the heater 113 to the surface of the fixing film 112.

The resin material can be heated easier than the metal, because the density is small and therefore, the thermal capacity is small. The resin material can be molded into a thin film by paint molding, and therefore, the manufacturing cost is low. In this embodiment, material of the base layer of the fixing film 112 is polyimide resin material, to which carbon filler material is added in order to improve the thermal conductivity and the strength. The heat transfer from the heater 113 to the surface of the fixing roller 110 increases, but the strength decreases, with decrease of the thickness of the base layer 126, and therefore, the thickness is preferably approx. 20 μm-100 μm, and in this embodiment, it is 60 μm.

The material of the parting layer 127 of the fixing film 112 is preferably fluorinated resin material such as perfluoroalkoxy resin material (PFA), polytetrafluoroethylene resin material (PTFE), tetrafluoroethylene-hexafluoropropylene resin material (FEP). In this embodiment, PFA is used since it is excellent in the parting property and the heat resistive. The parting layer 127 may be coated with a tube, or may be coated with the paint.

In this embodiment, the parting layer 127 is provided by coating since it is good in the thin molding. The heat transfer from the heater 113 to the surface of the fixing film 112 increases, but the durability decreases with decrease of the thickness of the parting layer 127, and therefore, it is preferably 5 μm-30 μm; in this embodiment, it is 10 μm.

(Pressing Roller)

The pressing roller 110 of this embodiment has an outer diameter of 20 mm and comprises a core metal 117 of steel having an outer diameter of 12 mm and an elastic layer 116 (foam rubber), thereon, of silicone rubber having a thickness of 4 mm. If the pressing roller 110 has a large thermal capacity and a large thermal conductivity, the heat tends to be absorbed into the inside from the surface of the pressing roller 110 with the result that the rising speed of the surface temperature of the pressing roller 110. In other words, a low thermal capacity and low thermal conductivity (high heat insulation effect) material is preferable from the standpoint of quick surface temperature rising of the pressing roller 110. The thermal conductivity of the silicone foam rubber is 0.11-0.16 W/m·K.

It is lower than a thermal conductivity of solid rubber which is approx. 0.25-0.29 W/m·K. The specific gravity which is concerned with the thermal capacity of the solid rubber is approx. 1.05-1.30, whereas that of the foam rubber is approx. 0.75-0.85, and therefore, the thermal capacity is low. Therefore, the foam rubber is effective to reduce the rising time of the surface temperature of the pressing roller 110. The outer diameter of the pressing roller 110 is preferably small from the standpoint of suppression of the thermal capacity, but if it is too small, the width of the fixing nip N may be too small, and therefore, a proper diameter is to be selected by ordinary skilled in the art, and in this embodiment, is outer diameter is 20 mm.

As regards the thickness of the elastic layer 116, if it is excessively thin, the heat escapes to the core metal, and therefore, a proper thickness is required, and in this embodiment, the thickness of the elastic layer 116 is 4 mm. On the elastic layer 116, the parting layer 118 of perfluoroalkoxy resin material (PFA) is provided for the parting property relative to the toner. Similarly to the parting layer 127 of the fixing film 112, the parting layer 118 may be provided by covering it with a tube, or by coating it with the paint, and in this embodiment, the tube exhibiting high durability is used.

The material of the parting layer 118 may be fluorinated resin material such as PFA, PTFE, FEP or the like, or silicone rubber or the like, which has a high parting property. A hardness of the surface of the of the pressing roller 110 is preferably low from the standpoint of enough width of the fixing nip N provided by light pressure, but if it is too low, the durable is not enough, and in this embodiment, it is 40-45° in Asker-C hardness (4.9 N load). The pressing roller 110 is rotated by rotating means (unshown) in the direction of an arrow R1 in the Figure at a surface moving speed of 60 mm/sec.

(Heater)

The heater 113 functioning as a nip formation member comprises a substrate of alumina having a width of 6 mm and a thickness 1 mm, an electric heat generating resistance layer of Ag/Pd coating the surface thereof into a thickness of 10 μm by a screen printing, and a heat generating element protection layer, thereon, of glass having a thickness of 50 μm. A rear surface of the heater 113 is provided with a temperature detecting element 115 for detecting a temperature of the ceramic substrate which is heated by the heat generation of the electric heat generating resistance layer. In accordance with an output signal of the temperature detecting element 115, a current flowing through the electric heat generating resistance layer from the electrode portion (unshown) provided at the longitudinal end portion is controlled to adjust the temperature the heater 113.

The heat of the heater 113 is transferred from an inner surface of the fixing film 112 to the surface to heat the surface of the pressing roller 110 through the fixing nip N. When the recording material P having the unfixed toner image T transferred thereto reaches the fixing nip N, the heat of the fixing film 112 and the pressing roller 110 is transferred to the unfixed toner image T and the recording material P to fix the toner image on the recording material P.

(Fixing Flange)

Figure 3:
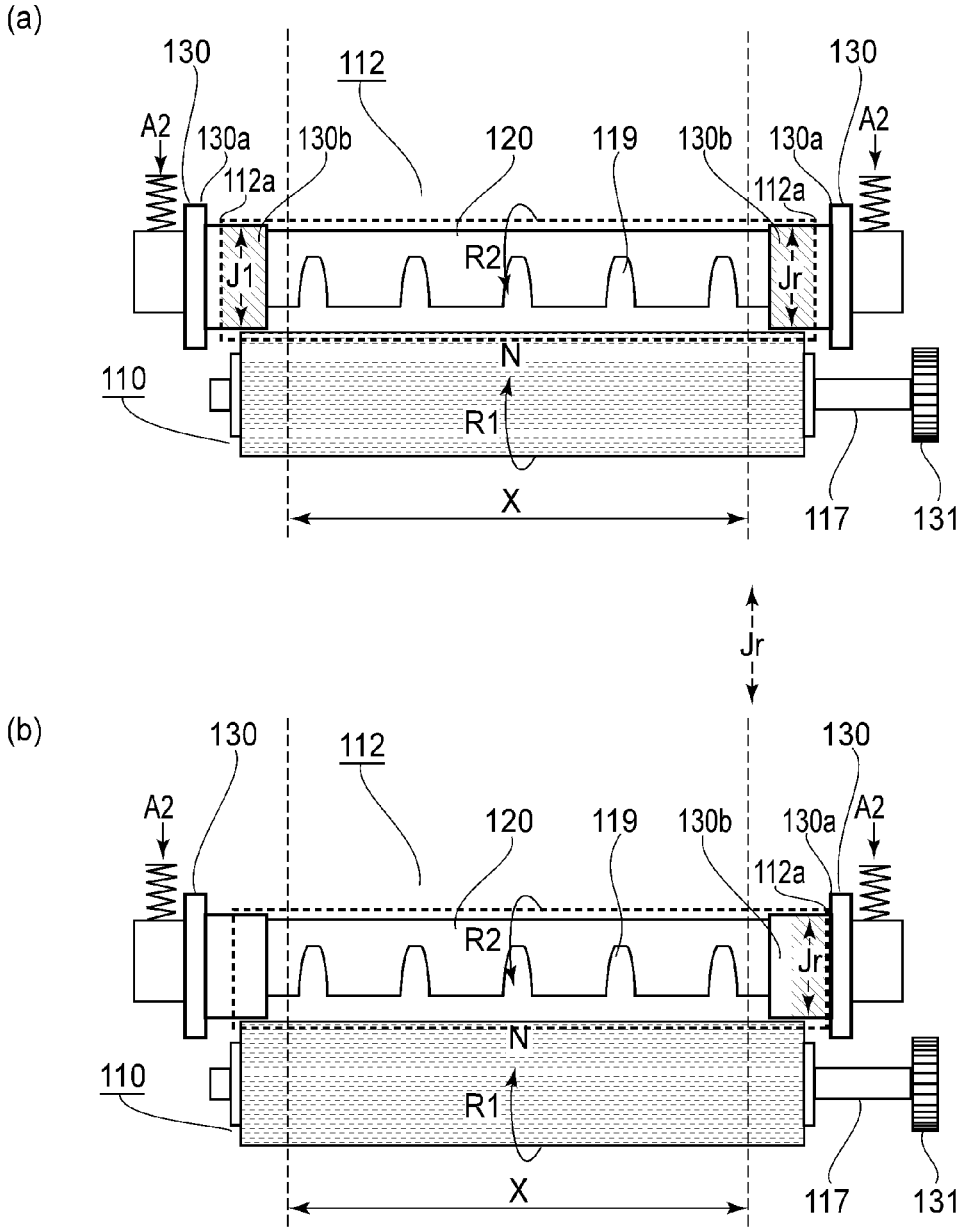
FIG. 3 are schematic views as seen from an upstream side with respect to a feeding direction at the time of normal rotation (a), and at the time of an occurrence of a shifting force, in the image heating apparatus according to the first embodiment.

Referring to FIG. 2, there is shown a schematic view of the image heating apparatus as seen in the direction of an arrow A1. Part (a) of FIG. 3 shows the state in which the fixing film 112 does not shift in the longitudinal direction (rotational axial direction). Here, the fixing film 112 is removed and shown by broken lines to show the inside of the fixing film 112. When the pressing roller 110 receivers the driving force from a driving gear 131, it is rotated in the direction of arrow R1 in the FIG. 3. Fixing film 112 is driven by the pressing roller 110 by the force received therefrom at the fixing nip N to rotate in the direction of an arrow R2 in the FIG. 3.

The fixing film 112 may shift in the longitudinal direction (left and right directions), and therefore, a fixing flange 130 (regulating member) is provided at each of the longitudinal end portions of the fixing film 112 to limit the shifting of the fixing film 112. Part (b) of FIG. 3 shows the case in which the fixing film 112 has shifted toward the driving gear 131. In such a case, an edge 112*a* of the fixing film abuts to a surface 130*a* of the fixing flange 130 to be limited.

In addition, the fixing flange 130 is provided with a fixing film guide surface 130*b* to guide an inner surface of the endless belt (fixing film) in the longitudinal end region with respect to the direction crossing with the rotating direction of the endless belt. When the fixing flange 130 contacts with and slides on the inner surface of the fixing film 112, the heat is deprived of the fixing film 112 by the fixing flange 130. In order to avoid the influence against the fixing of the toner on the recording material, a film guide portion 130*b* which contacts with and slides on the inner surface of the fixing film 112 guides the inner surface of the fixing film 112 by the portions longitudinally outside of recording material feeding region X.

In the normal cases, when the inner surface of the fixing film 112 is contacted to the film guide portion 130*b* of the fixing flange 130, an edge of the film is contacted to the surface 130*a* of the fixing flange 130. When there is no shifting of the fixing film 112 in the longitudinal direction (part (a) of FIG. 3), the fixing film 112 receives the driving force from the pressing roller 110 at the fixing nip N in the direction from the upstream side to the downstream side with respect to the feeding direction. By this, the fixing film 112 moves toward the downstream side with respect to the feeding direction so that it contacts to and is guided by the upstream surface of the surface 130*b* of the fixing film guide (left and right hatching lines portion Jr and Jl) in part (a) of FIG. 3).

When the fixing film 112 shifts toward the driving gear 131 (part (b) of FIG. 3), the fixing flange 130 closer to the fixing film 112 is contacted by the inner surface fixing film 112 at the upstream surface (right-hand hatching lines portion Jr of part (b) of FIG. 3) and the guide the fixing film 112. At the opposite side on the other hand, the fixing film 112 moves toward the upstream side with respect to the feeding direction, and therefore, the upstream surface of the fixing flange 130 does not guide the fixing film 112. This will be described in more detail.

(Shifting of the Fixing Film During Normal Rotation)

When the pressing roller 110 and the fixing film 112 rotate normally, the pressing roller 110 feeds the fixing film in the circumferential direction (rotational moving direction) by a force which is uniform in the longitudinal direction (rotational axial direction). However, it may happen that the force for feeding the fixing film 112 is not uniform in the longitudinal direction. For example, it happens when the alignment of the fixing film 112 and/or the pressing roller 110 is offset between the left and right sides, when the balance of the urging spring 114 between the left and right sides, when the outer diameters and/or the fixing film 112 of the left and right sides of the pressing roller 110 are not the same, or the like.

Figure 4:
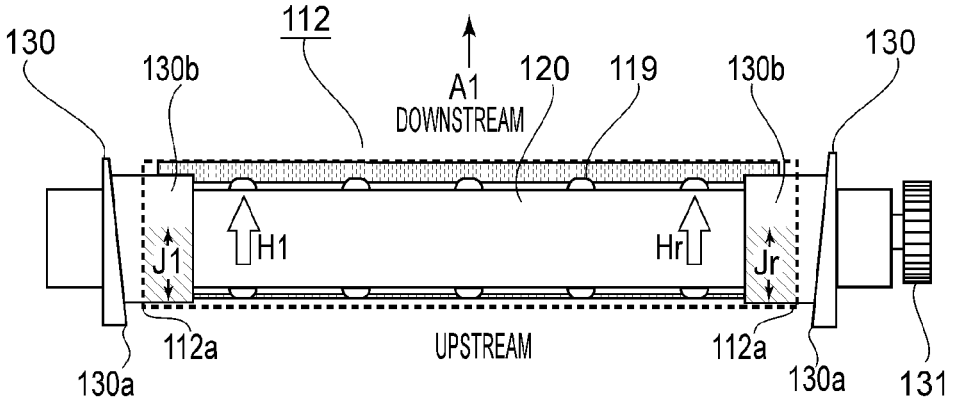
FIG. 4 is an illustration of a nip as seen from the top at the time of normal rotation (a) and at the time of the generation of the shifting force.
Figure 4:
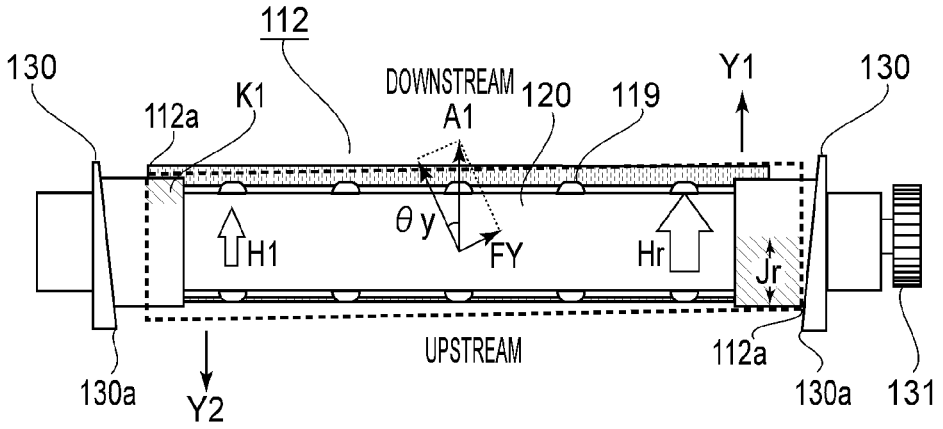

In such a case, the fixing film 112 tends to shift toward the side where that feeding force of the pressing roller 110 is stronger. In FIG. 4, there is shown a schematic view as seen in the direction of the arrow A2 of FIG. 3 (from the top side of the heating apparatus the. Part (a) of FIG. 4 is a schematic view when no shifting of the fixing film 112 occurs (part (a) of FIG. 3), and part (b) is a schematic view when the fixing film 112 has shifted toward the driving gear 131 (righthand side in the Figure) ( ) of the 3). The feeding force for the fixing film 112 by the pressing roller 110 in the fixing nip N is divided into left and right sides, and the feeding force in the driving side having the driving gear 131 is Hr, and the feeding force in the non-driving side is Hl.

When the left and right feeding forces Hr and Hl are the same, no shifting of the fixing film 112 in the longitudinal direction occurs, and the fixing film 112 is guided by the upstream surfaces Jr and Jl (left and right hatching lines portion of the part (a) of FIG. 4) of the fixing flange 130 at the opposite ends, as shown in part (a) of FIG. 4. On the other hand, if the feeding force Hr for the fixing film 112 becomes larger than the feeding force Hl, the fixing film 112 shifts toward the driving gear 131 (righthand side in the Figure).

In this case, as shown in part (b) of FIG. 4, the side of the fixing film 112 where the feeding force Hr is larger (driving gear 131 side, here) inclines to the downstream side (arrow Y1 direction), and the side where the feeding force Hl is smaller inclines to the upstream side (arrow Y2 direction). When the fixing film 112 inclines by an angel θy relative to the feeding direction Al, a component force FY of the feeding force of the fixing film 112 applies in direction of the driving gear 131. Therefore, the fixing film 112 shifts while inclining, toward the driving gear 131 where the feeding force is large.

Because of this inclination of the fixing film 112, the upstream surface (right-hand hatching lines portion Jr of the part (b) of FIG. 4) of the fixing flange 130 of the driving gear 131 side contacts and guides the fixing film 112.

In the opposite side on the other hand, the fixing film 112 inclines toward the upstream side (direction of arrow Y2), and therefore, the fixing film 112 does not contact the upstream surface the fixing flange 130, and the downstream surface (left-hand hatching lines portion Kl of the part (b) of FIG. 4) contacts and guides the fixing film 112. In this manner, the inclination of the fixing film 112 is limited. As will be understood from the foregoing, when the fixing film 112 shifts in the longitudinal direction, the shifted side relatively inclines toward the downstream side (arrow Y1 direction), and therefore, the upstream surface of the fixing flange 130 (right-hand hatching lines portion Jr of the part (b) of FIG. 4) necessarily contacts and guides the fixing film 112. (Shifting of the fixing film during jam clearance operation)

The shifting of the fixing film 112 upon the jam clearance operation will be described. When the recording material remains in the image heating apparatus, the user carries out the jam clearance operation to remove the jammed recording material from the downstream side of the heating apparatus with respect to the feeding direction. At this time, if the recording material is pulled straight in the feeding direction, no shifting force is applied to the fixing film 112, but if the recording material is pulled obliquely, a shifting force which is larger than that during the normal rotation may be applied to the fixing film 112.

FIG. 4 is a schematic view when the recording material P is pulled out in a direction toward the driving gear 131 from the downstream side at an angel θj. When the recording material P is pulled by a force HU, the component force toward the driving gear 131 is FJ (shifting force), the shifting force FJ May be larger than the shifting force during the normal rotation of the fixing film 112, depending on the angle θj and the jam clearance force HU. In this case, the fixing film abuts strongly to the opposing surface 130*a* of the fixing flange 130.

Figure 5:
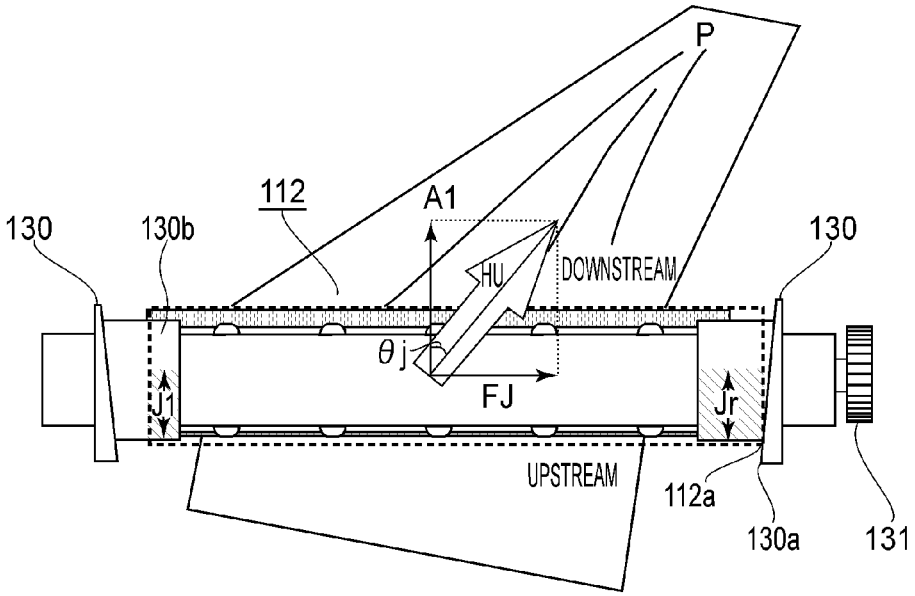
FIG. 5 is an illustration when the shifting force is applied to a fixing film during a jam clearance operation.

In the case that the jam clearance operation is carried out from the downstream side with respect to the feeding direction, the fixing film 112 is pulled strongly toward the downstream side by the pulling force to the recording material P. Therefore, the opposite ends of the fixing film 112 is contacted to upstream surface of the left and right fixing flanges 130 (left and right hatching lines portion Jr and Jl of FIG. 5) and is guided thereby. In the case of the shifting of the fixing film 112 due to the jam clearance operation, the fixing film 112 do not incline, as is contrasted to the case of the shifting during the normal rotation, and the opposite ends of the fixing film 112 shift while being guided by the upstream surface (left and right hatching lines portions Jr and Jl of FIG. 5) of the left and right fixing flanges 130.

The foregoing is summarized as follows: As regards the shifting of the fixing film 112 in the longitudinal direction, both during the normal rotation and by the jam clearance operation, the upstream surface of the fixing flange 130 to which the fixing film 112 comes close is necessarily contacted by the inner surface of the fixing film 112 and guides the fixing film 112. (Edge damage of the conventional fixing film (comparison example))

In the case that the fixing film 112 shifts in the longitudinal direction by a strong shifting force, the fixing film 112 abuts the regulation surface of the fixing flange, the edges of the fixing film 112 may be damaged. This will be described in detail.

Figure 6:
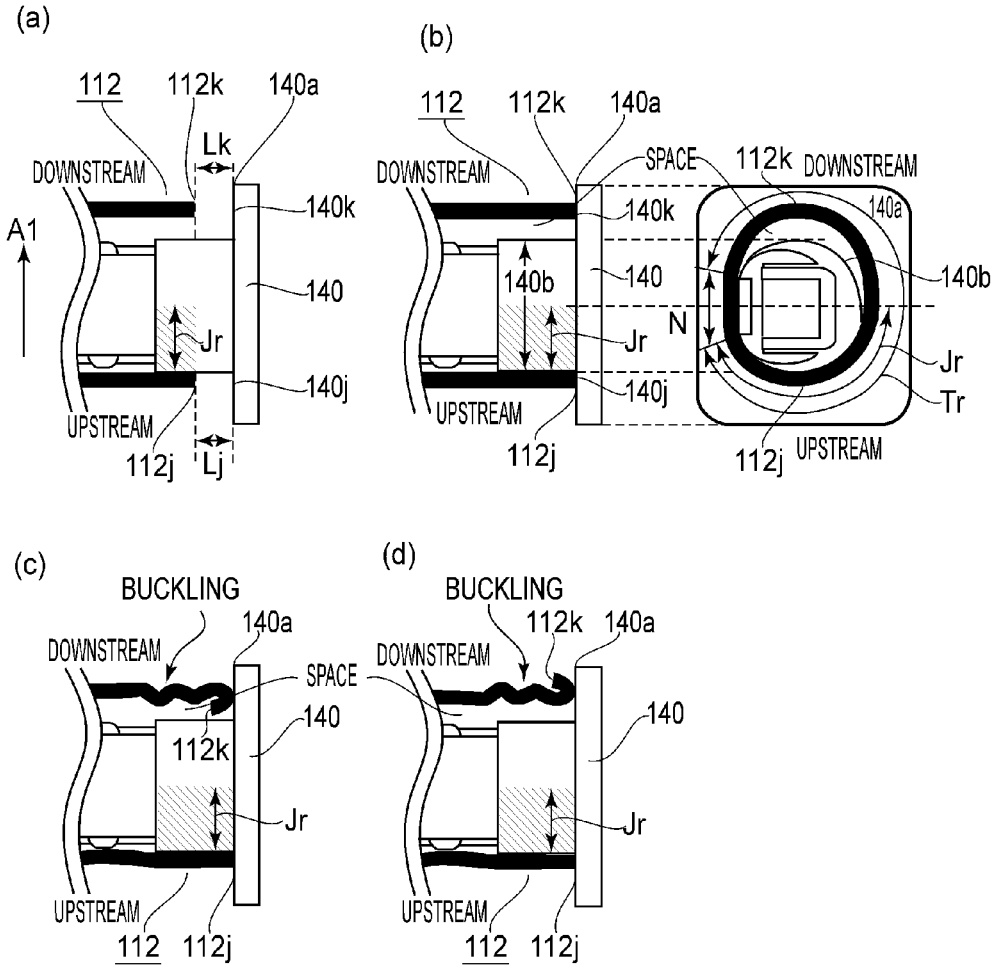
FIG. 6 are enlarged views of a conventional fixing flange portion in a comparison example.

FIG. 6 is a schematic view illustrating edge damage of the film in a conventional fixing flange as a comparison example. FIG. 6 is a top plan view of the nip. FIG. 6 is an enlarged view when the edge of the fixing film 112 abuts to the film regulation surface of the fixing flange in the case that the fixing film 112 shifts toward the driving gear 131 side (righthand side in the Figure) as shown in part (b) of FIG. 4 or FIG. 5. Part (a) of FIG. 6 is a schematic view before the fixing film 112 abuts to the fixing flange 140.

Here, a clearance between the longitudinal end portion of the fixing film 112 and the fixing film regulation surface 140*a* of the fixing flange 140 (shifting regulating portion). As shown in part (a) of FIG. 6, the clearance at an upstreammost portion with respect to the feeding direction of the fixing film 112 is Lj, and the clearance at a downstreammost portion with respect to the feeding direction of the fixing film 112 is Lk. In the conventional example of the fixing film regulation surface 140*a* of the fixing flange, Lj is substantially the same as Lk.

Therefore, when the fixing film 112 abuts to and is limited by the fixing flange 140, a fixing film upstreammost end portion 112*j* and a fixing film downstreammost end portion 112*k* abut to and is limited by the regulation surface 140*a* of the fixing flange 140. Part (b) of FIG. 6 is a schematic view when the fixing film 112 just abuts to the fixing flange 140, and a sectional view of the regulation surface 140*a* of the fixing flange 140.

In the case of the conventional fixing flange 140, when the shifting of the fixing film 112 in the longitudinal direction is limited, the upstream and downstream portions of the end portion of the fixing film 112 (112*j*, 112*k* in part (b) of FIG. 6) abut to the regulation surface 140*a* of the fixing flange 140. Therefore, as shown in part (b) of FIG. 6, the film end surface regulation region Tr for limiting the longitudinal shifting of the fixing film 112 contacts with and slides on the end portion of the fixing film 112 in a wide region including the upstream portion and the downstream portion to limit the shifting of the fixing film 112. In other words, in the regulation surface 140*a*, the upstream side film end surface regulation region Tr and the downstream side film end surface regulation region Tr with respect to the center portion of the nip in the recording material feeding direction are the same.

Here, the film inner surface guide region Jr is a contact region where the film inner surface contacts the fixing flange 140 as the regulating member, and the film end surface regulation region Tr is a contact region where the edge of the fixing film 112 contacts the fixing flange 140 as the regulating member during the fixing process operation.

On the other hand, when the fixing film 112 shifts in the longitudinal direction, in the fixing flange approached by the fixing film 112, the fixing film 112 is guided always while the inner surface of the fixing film 112 is in contact with the upstream surface of the fixing flange. If an outer circumferential length of the guide portion 140*b* for guiding the inner surface of the fixing film is larger than an inner circumferential length of the fixing film 112, the rotation of the fixing film 112 is obstructed, and therefore, the outer circumferential length of the guide portion 140*b* is smaller than the inner circumferential length of the fixing film 112.

For this reason, when the inner surface of the fixing film 112 contacts the upstream surface of the fixing flange, the guide portion 140*b* does not contact the inner surface of the fixing film 112 in the downstream side with the result of leaving a space there. An inner surface of the fixing film 112 contacts to and is guided by the fixing flange in the upstream of the film inner surface guide region Jr upstream of the guide portion 140*b*, and in the downstream side, the inner surface of the fixing film 112 does not contact the fixing flange guide portion 140*b*.

That is, when the shifted fixing film 112 is limited by the fixing flange 140, the end portion of the fixing film 112 contacts the fixing film regulation surface 140*a* in the film end surface regulation region Tr, by which the shifting is limited. Simultaneously, the inner surface of the fixing film 112 contacts to and is guided by the fixing flange guide portion 140*b* in the upstream side film inner surface guide region Jr.

In the conventional fixing flange 140, the film end surface regulation region Tr is larger than the upstream side film inner surface guide region Jr. Therefore, in the upstream side, the shifting of the film is limited by the portion guiding the inner surface of the film, but in the downstream side, the shifting of the film is limited by a portion not guiding the inner surface of the film. If a further shifting force is applied to the fixing film 112, the fixing film 112 will be folded, buckled and/or cracked in the downstream side first. Part (c) of FIG. 6 and part (d) of FIG. 6 are schematic views when a film edge damage (folded or buckled).

In the upstream side, the inner surface of the fixing film 112 contacts to and is guided by the fixing flange guide portion 140*b* in the upstream side film inner surface guide region Jr, and therefore, the folding and/or the yielding of the fixing film upstream end portion 112*j* does not easily occur. On the other hand, the space is produced between the fixing film 112 and the fixing flange guide surface 140*b* as described above, and the inner surface of the fixing film 112 is not guided by the fixing flange guide surface 140*b*. Therefore, the downstream end portion 112*k* of the fixing film relatively easily folded back inward as shown in part (c) of FIG. 6, or relatively easily folded back outward as shown in part (d) of FIG. 6.

Since the fixing film 112 shifts while rotating, it is possible that a circumferential part of the fixing film 112 is inwardly folded back, and another circumferential part thereof is outwardly folded back. If this occurs, the end portion of the fixing film 112 may be torn at the boundary between the inwardly folded portion and the outwardly folded portion. When the space is produced in the downstream side as described above, the buckling as shown in part (c) of FIG. 6 and part (d) of FIG. 6 tends to occur since there is no part supporting the inner surface of the fixing film 112.

Thus, in the conventional fixing flange 140, the film end surface regulation region Tr is larger than the upstream side film inner surface guide region Jr.

In addition, the inner surface of the fixing film 112 is guided by the fixing flange guide portion 140*b* in the upstream side of the center portion the nip with respect to the recording material feeding direction, but it is not guided in the downstream side of the center portion the nip with respect to the recording material feeding direction. However, in the opposing surface 140*a*, the upstream side and the downstream side of the center portion of the nip with respect to the recording material feeding direction have the same areas of the film end surface regulation regions Tr effective to regulate the edge of the fixing film 112. Therefore, in the upstream side, the shifting of the film is limited by the portion where the inner surface of the film is guided, but in the downstream side, the shifting of the film is limited by the portion where the inner surface of the film is not guided.

(Structure of the Fixing Film Regulation of the Fixing Flange)

Figure 1:
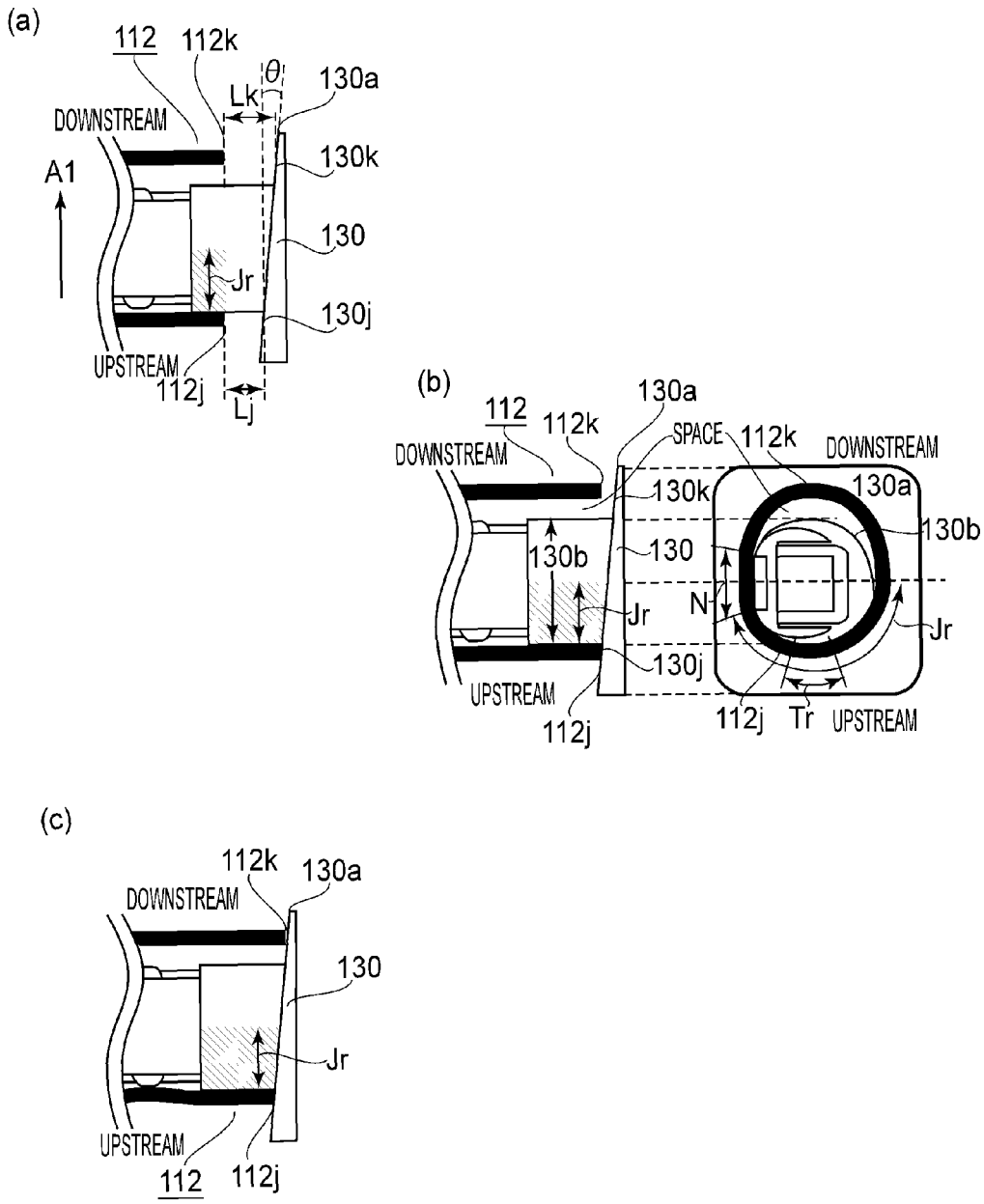
FIG. 1((*a*)-(*c*)) are enlarged views of a fixing flange portion according to a first embodiment of the present invention.

With the structure of the fixing flange 130 of this embodiment, the shifting of the fixing film 112 in the longitudinal direction (rotational axial direction) is limited by the portion included in the upstream region guiding the inner surface of the fixing film 112 as seen from the top of the nip. Therefore, the edge damage of the film does not easily occur. FIG. 1 is a top plan view of the nip and is a schematic view of the shifting limitation to the fixing film 112 by the fixing flange 130 of this embodiment. Similarly to the FIG. 6, it is an enlarged view of a portion where the edge of the fixing film 112 abuts to the surface 130*a* opposing to the edge of the fixing film 112 of the fixing flange 130 when the fixing film 112 shifts toward the driving gear 131.

Part (a) of FIG. 1 is a schematic view before the fixing film 112 abuts to the fixing flange 130, part (b) of FIG. 1 is a schematic view when the fixing film 112 just abuts to the fixing flange 130 and a sectional view of the opposing surface 130*a* of the fixing flange 130. As shown in the sectional view of the part (b) of FIG. 1, in the fixing flange 130 of this embodiment, the film end surface regulation region Tr is smaller than the upstream side film inner surface guide region Jr with respect to the recording material feeding direction. The shifting of the film is limited only by the upstream side region included in the portion where the film inner surface is guided, and therefore, the edge damage of the film does not easily occur.

In the fixing flange 130 of this embodiment, the opposing surface 130*a* of the fixing flange 130 includes a film end surface regulation region Tr, and an offset region which is offset away from the edge of the fixing film 112 as compared with the film end surface regulation region Tr. The film end surface regulation region Tr is upstream of the center portion of the nip with respect to the recording material feeding direction, and is not in the downstream side thereof.

(Prevention of the Edge Damage of the Film)

The prevention of the edge damage of the film will be described in detail. As shown in part (a) of FIG. 1, the fixing film opposing surface 130*a* of the fixing flange 130 of this embodiment is inclined by a taper angle θ so as to be away from the edge of the fixing film as the distance toward the downstream side from the upstream side increases relative to the center portion of the nip with respect to the recording material feeding direction. An upstreammost end portion 112*j* of the fixing film 112 and upstreammost regulation surface 130*j* abutted by the fixing film upstreammost end portion 112*j* are spaced from each other by a clearance Lj.

A downstreammost end portion 112*k* of the fixing film 112 and a downstreammost regulation surface 130*k* abutted by the fixing film downstreammost end portion 112*k* are spaced from each other by a clearance Lk. With the fixing film opposing surface 130*a* of this embodiment, the clearance Lk is larger than the clearance Lj. In this embodiment, the taper angle θ of the fixing film opposing surface 130*a* of the fixing flange 130 is such that the downstream side clearance Lk is larger than upstream side clearance Lj by approx. 500 μm, for example.

In FIG. 1, in the entire region of the taper angle θ, the clearance between the edge of the fixing film 112 and the fixing film opposing surface 130*a* gradually increases toward the downstreammost portion with respect to the recording material feeding direction. The downstream side clearance Lk is larger than the upstream side clearance Lj, and therefore, when the fixing film 112 abuts to the fixing flange 130, the upstreammost end portion 112*j* of the fixing film first abuts to the fixing film opposing surface 130*a* at all times. That is, as shown in the sectional view of the part (b) of FIG. 1, the fixing flange 130 of this embodiment is first abutted, when limiting the longitudinal shifting of the fixing film 112, by the upstreammost end portion 112*j* of the fixing film, at the fixing film opposing surface 130*a*.

Therefore, it is contacted by an upstream part (film end surface regulation region Tr) of the fixing film 112 including the upstreammost end portion 112*j* of the fixing film to limit the shifting of the fixing film 112. Here, when the fixing film 112 shifts in the longitudinal direction, the operation is such that in the fixing flange approached by the fixing film 112, the fixing film 112 shifts while the inner surface of the fixing film 112 is in contact with the upstream surface of the fixing flange, at all times.

For this reason, when the inner surface of the fixing film 112 contacts the upstream surface of the fixing flange, the guide portion 130*b* does not contact the inner surface of the fixing film 112 in the downstream side with the result of leaving a space there. An inner surface of the fixing film 112 contacts to and is guided by the fixing flange in the upstream of the film inner surface guide region Jr upstream of the guide portion 130*b*, and in the downstream side, the inner surface of the fixing film 112 does not contact the fixing flange guide portion 130*b*.

That is, when the shifted fixing film 112 is limited by the fixing flange 130, the end portion of the fixing film 112 contacts the fixing film opposing surface 130*a* in the film end surface regulation region Tr, by which the shifting is limited. Simultaneously, the inner surface of the fixing film 112 contacts to and is guided by the fixing flange guide portion 130*b* in the upstream side film inner surface guide region Jr. As is different from the conventional fixing flange 140, in the case of the fixing flange 130 of this embodiment, in the upstream side film inner surface guide region Jr which is the contact region between the inner surface of the endless belt and the guide portion, the film end surface regulation region Tr which is the contact region between the edge of the endless belt and the shifting regulating member.

Referring to part (b) of FIG. 1, when the fixing film 112 as the rotatable member shifts in the rotational axial direction, a range T in the circumferential direction in which the edge of the rotatable member contacts the shifting regulating member is smaller than a range J in the circumferential direction in which the inner surface of the rotatable member contacts the guiding member.

Therefore, in the downstream side portion where the inner surface of the fixing film 112 is not guided, the edge of the fixing film 112 opposes the offset region which is offset away from the edge of the fixing film 112 as compared with the film end surface regulation region Tr of the opposing surface 130*a*, and therefore, does not contact the opposing surface 130*a* normally. By doing so, with the fixing flange 130 of this embodiment, the inward folding, the outward folding, the cracking or the buckling which occurs with the conventional fixing flange can be prevented. The offset region of the opposing surface 130*a* of the fixing flange 130 is at least in the downstream side of the center portion of the nip with respect to the recording material feeding direction.

Part (c) of FIG. 1 is an illustration when the fixing film 112 receives a further shifting force by the jam clearance operation or the like. In such a case, in the downstream side where the inner surface of the fixing film 112 is not guided, the edge of the fixing film 112 may contact to the offset region of the opposing surface 130*a* of the fixing flange. However, the shifting is fundamentally limited within the upstream side film inner surface guide region Jr where the inner surface of the fixing film 112 is guided. Therefore, a contact pressure between the edge of the fixing film 112 and the opposing surface 130*a* in the offset region is not high, so that the edge damage of the film does not easily occur.

Effect of This Embodiment

A comparison test has been carried out about the easiness of occurrence of the end portion of the film between the conventional fixing flange 140 and the fixing flange 130 this embodiment in which the taper angle θ is provided such that the gap between the regulating surface and the edge of the fixing film 112 increases toward the downstream side from the upstream side with respect to the recording material feeding direction. The comparison is made as to the edge damage of the film when the shifting force is strong due to the jam clearance operation and in the sheet processing operations.

In order to measure the shifting force to the fixing film when the edge damage of the film occurs, a load cell for detecting the pressure is mounted to the end portion of the fixing flange, and the shifting force applied to the fixing flange is measured in the jam clearance operation. The jam clearance operation is carried out in the downstream side of the heating apparatus, the angle at which the recording material is pulled out, relative to the feeding direction of the recording material is changed, by which the shifting force is changed. Prior to the comparison or the shifting force has been measured while changing the pulling angle, and the shifting force can be increased to 3000 gf (maximum).

For the purpose of comparison as to the strength of the fixing film, fixing films having base layers of 40 μm, 50 μm, 60 μm, 70 μm thicknesses are tested. In addition, differences in the fixing property depending on the differences in the base layer film thickness (strength) of the fixing film have also been checked. The fixing property is represented by a density decrease rate which is calculation in the following manner: The used measuring device is a Macbeth reflection density meter RD914, and five lens cleaning paper sheets are placed on paper on which a half-tone image is fixed, and rubs the image by five reciprocations at the load of 0.4 N/cm^2, the image densities before and after the rubbing.

In this embodiment, the half tone image has a density D1 of approx. 0.7 before the rubbing. The density decrease rate is calculated by (D1−D2)/D1 where D2 is a density after the rubbing. A black monochromatic half-tone image is printed, and the density decrease rate is measured to evaluate the fixing property. The satisfactory fixing property "G" is discriminated by the density decrease rate less than 10%, the fair fixing property "F" is discriminated by the density decrease rate not less than 10% and less than 20%, and the improper fixing property "NG" is discriminated by the density decrease rate not less than 20%. The discrimination criteria of the fixing property depend on the specification of the device, and the required fixing property can be properly selected depending on the apparatus performance.

In order to easily produce the shifting force to check the edge damage of the film during the sheet processing operation, the balance of the pressures of the urging springs 114 provided at the opposite longitudinal end portions is deviated. With the structure of this embodiment, the normal pressure of each of the urging springs 114 is 73.5 N (total pressure is 147N). However, for the comparison, the pressure of the urging spring of the driving side is 80.85 N (plus 10%), and that of the driven side is 66.15 N (minus 10%) in the test sheet processing operation.

The feeding force for the fixing film 112 by the pressing roller 110 is higher in the driving side where the pressure is high than in the driven side where the pressure is low, and therefore, the fixing film 112 tends to shift toward the driving side as described above. Prior to the test operation, the shifting force was measured by the load cell, and the average shifting force during the sheet processing was approx. 500 gf. The sheet processing operations were carried out toward 100,000 sheets which was 2 times the lifetime of the image heating apparatus, and the end folding, buckling, cracking were checked. Table 1 shows the results of the comparison with respect to the edge damage of the film.

TABLE 1

| | Base Layer thickness | Fixing Property | Shifting force at which edge damage occurred (Jam clearance operation) (gf) | No. of processed sheets at which edge damage occurred (fixing operation) |
|---|---|---|---|---|
| Conventional | 40 μm | E | 600 | 10,000 |
| | 50 μm | E | 1200 | 50,000 |
| | 60 μm (=Emb. 1) | G | 2000 | >100,000 |
| | 70 μm | NG | >3000 | >100,000 |
| Embodiment 1 | 40 μm | E | 1000 | 50,000 |
| | 50 μm | E | 2000 | >100,000 |
| | 60 μm (=Emb. 1) | G | >3000 | >100,000 |
| | 70 μm | NG | >3000 | >100,000 |

E: excellent
G: good
NG: no good

According to the results of the comparison as to the edge damage of the film due to jam clearance operation, when the base layer film thickness is 40 μm, the conventional fixing flange broke the film edge at 600 gf, but the fixing flange of this embodiment did not break the edge up to 1000 gf. In the case of 50 μm of the base layer film thickness, the conventional fixing flange broke the film edge at 1200 gf, and the fixing flange of this embodiment did not break the film edge until 2000 gf. That is, with the fixing flange of this embodiment, the film is durable twice the conventional fixing flange.

In addition, the fixing flange of this embodiment did not suffer from the film edge damage by the jam clearance operation when the base layer film thickness is not less than 60 μm. When the base layer film thickness was 40 μm, the conventional fixing flange broke the film edge at about 10,000 sheets processed, but the fixing flange of this embodiment did not break the film edge until 50,000 sheets processed. When the base layer film thickness was 50 μm, the conventional fixing flange broke the film edge at 50,000 sheets processed, but the fixing flange this embodiment did not break the film edge until 100,000 sheets processed, which was twice the lifetime of the heating apparatus.

As regards the fixing property, when the film thickness of the base layer was not more than 60 μm, no improper fixing occurred, and when it was 50 μm, the image density decrease ratio was as small as less than 10%, which means satisfactory fixing property. Therefore, with the fixing flange 130 of this embodiment, when the base layer film thickness with which no improper fixing occurs, occurrence of the film edge damage due to the jam clearance operation and the long term fixing operation can be suppressed.

With the fixing flange 130 of this embodiment, the longitudinally shifting of the fixing film 112 is limited only by a region upstream of the center portion of the nip with respect to the recording material feeding direction, the region being within the portion where the inner surface of the fixing film 112 is guided. The opposing surface 130*a* of the fixing flange 130 includes an end surface regulation region Tr, and an offset region offset in the direction away from the edge of the fixing film 112. The film end surface regulation region Tr is upstream of the center portion of the nip with respect to the recording material feeding direction, and is not in the downstream side thereof. By this, the occurrence of the film edge damage can be suppressed.

In this embodiment, the film end surface regulation region Tr of the opposing surface 130*a* of the fixing flange 130 is in the upstream side of the center portion of the nip with respect to the recording material feeding direction, and is not in the downstream side thereof. However, the film end surface regulation region Tr may be in the downstream side of the center portion of the nip with respect to the recording material feeding direction. It will suffice if the film end surface regulation region Tr is narrower in the downstream side than in the upstream side relative to center portion of the nip with respect to recording material feeding direction. In the foregoing, the fixing flange 130 provided in the driving side (driving gear 131 side) has been described, but the structures are similar also in the driven side, and the same advantageous effects are provided. In this embodiment, the taper angle θ of the fixing film opposing surface 130*a* of the fixing flange 130 is such that the downstream side clearance Lk is longer than the upstream side clearance Lj by approx. 500 μm, as a example. However, the difference between the downstream side clearance Lk and the upstream side clearance Lj is not restrictive.

As another example, when the strength of the fixing film is very low, the end portion folding or buckling may occur even in the upstream portion where the inner surface of the fixing film 112 is guided, depending on the shifting force. In such a case, the taper angle θ is made small to reduce the difference between the downstream side clearance Lk and the upstream side clearance Lj, by which the shifting of the fixing film is received partly by the downstream side before the fixing film is damaged in the upstream side, so that the film edge damage can be suppressed.

The strength of the fixing film and/or the shifting force of the fixing film is different depending on the structure of the image heating apparatus, and therefore, the difference between the downstream side clearance Lk and the upstream side clearance Lj may be optimized, matching the specific structures of the image heating apparatus.

As described in the foregoing, according to this embodiment, the clearance between the axial end of the endless belt and the shifting regulating portion is predetermined as seen from the top of the nip. When a large shifting force is applied to the endless belt (during the normal printing operation or the jam clearance operation), the end portion damage of the endless belt can be suppressed.

Embodiment 2

A second embodiment of the present invention will be described. In this embodiment, the image forming apparatus for forming the unfixed toner image is the same as with the first embodiment, and therefore, the description thereof will be omitted. In addition, the image heating apparatus of this embodiment is a film heating type as with the first embodiment, and therefore, in the description of this embodiment, the same reference numerals as in Embodiment 1 are assigned to the elements having the corresponding functions in this embodiment, and the detailed description thereof is omitted for simplicity. Similarly to the first embodiment, the shifting of the fixing film 112 in the longitudinal direction is limited only by an upstream, with respect to feeding direction, the portion where an inner surface of a fixing film 112 is guided.

However, the regulation surface for regulating is shifting of the fixing film 112 is wider than in the first embodiment. Therefore, the occurrence of the film edge damage can be suppressed more than with the structure of the fixing flange 130 of the embodiment 1.

(Fixing Film Regulation Surface of the Fixing Flange)

Figure 7:
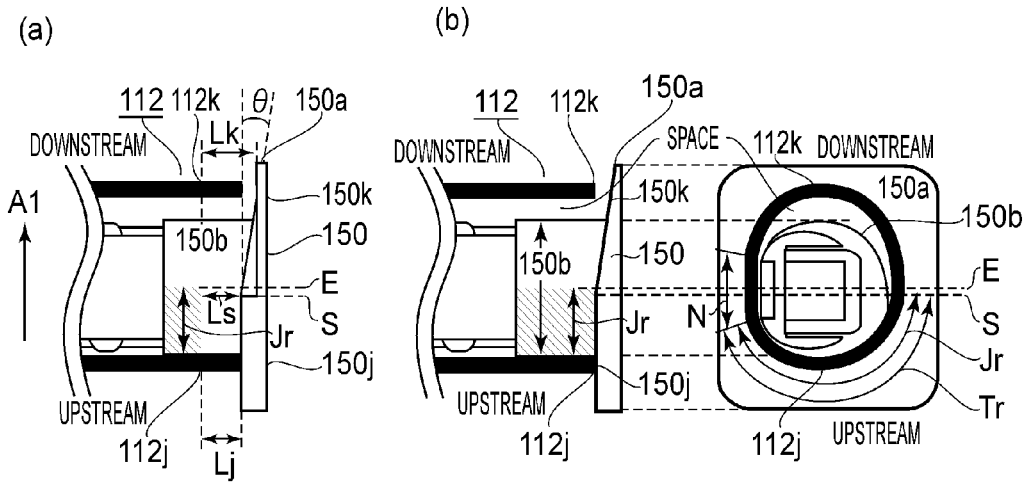
FIG. 7 is an enlarged view of a fixing flange portion according to a second embodiment of the present invention.

FIG. 7 is a schematic view illustrating the limitation to the shifting of the fixing film 112 by a fixing flange 150 of this embodiment. FIG. 7 is an enlarged view similar to the FIG. 1 in which the fixing film 112 shifts toward the driving side (righthand side in the Figure) to the extent that an edge of the fixing film 112 abuts to a film opposing surface 150*a* of the fixing flange 150. Part (a) of FIG. 7 is a schematic view before the fixing film 112 abuts to the fixing flange 150.

A fixing film opposing surface 150*a* of the fixing flange 150 of this embodiment is tapered by a taper angle θ such that it is away from the edge of the fixing film 112 to the downstream from a S portion approx. 1 mm upstream of an E portion which is a downstream end (center portion of a nip with respect to the recording material feeding direction) of an upstream film inner surface guide region Jr. The upstream side film inner surface guide region Jr contacts and guides the inner surface of the fixing film 112 at a position upstream of the center portion of the nip with respect to the recording material feeding direction.

An upstreammost end portion 112*j* of the fixing film 112 and upstreammost regulation surface 150*j* abutted by the fixing film upstreammost end portion 112*j* are spaced from each other by a clearance Lj. The edge of the fixing film 112 is spaced from the portion S at which the taper angle θ of said fixing film opposing surface 150*a* starts, by a clearance Ls. The clearance Lj and the clearance Ls are substantially the same, and the fixing film opposing surface 150*a* before the taper angle θ starts is perpendicular to the nip.

That is, in the zone from an upstreammost portion of the fixing film 112 (endless belt to the nip, a clearance between the edge (with respect to longitudinal direction) of the fixing film 112 and the opposing surface 150 is constant (in the direction perpendicular to the nip) to form a regulation region. The regulation region is constituted by a surface parallel with the edge of the fixing film 112. A downstreammost end portion 112*k* of the fixing film 112 and a downstreammost regulation surface 150*k* abutted by the fixing film downstreammost end portion 112*k* are spaced from each other by a clearance Lk. Then, in the fixing film opposing surface 150*a* of this embodiment, the clearance Lk is larger than the clearance Lj and the clearance Ls. In this embodiment, the fixing film opposing surface 150*a* of the fixing flange 150 is tapered by taper angle θ such that the downstream side clearance Lk is larger than the upstream side clearance Lj and the clearance Ls by approx. 500 μm, for example.

The region in which the opposing surface 150*a* is provided with the taper angle θ is an offset region which is offset away from the edge of the fixing film 112 as compared with the regulation region.

That is, in FIG. 7, in the region (offset region) where θ taper angle θ is provided, the clearance between the edge of the fixing film 112 and the fixing film opposing surface 150*a* gradually increases toward the downstreammost portion with respect to the feeding direction of the recording material. And, the downstream side clearance Lk is larger than the upstream side clearance Lj, and therefore, when the fixing film 112 abuts to the fixing flange 150, the fixing film upstreammost end portion 112*j* first abuts to the regulation region of the fixing film opposing surface 150*a*, at all times.

Part (b) of FIG. 7 is a schematic view and a sectional view of the opposing surface 150*a* the fixing flange 150 when the fixing film 112 just abuts to the fixing flange 150. The edge of the fixing film 112 abuts to the fixing flange opposing surface 150*a* in the regulation region Tr which ranges from the upstreammost regulation region 150*j* to which the fixing film upstreammost end portion 112*j* abuts to the portion S where the taper angle θ of the surface 150*a* starts.

In this embodiment, as compared with the structure of the first embodiment, the regulation region Tr to which the edge of the fixing film 112 abuts is wide, and is close to the entire area of the upstream side film inner surface guide region Jr for contacting and guiding the inner surface of the fixing film 112 in the upstream side. Therefore, the shifting force can be dispersed more widely than with the structure of the first embodiment in regulating the shifting of the fixing film 112. Therefore, even if a shifting force which is stronger than in the first embodiment, the film edge damage can be avoided.

Effect of Embodiment 2

With the structure of the fixing flange 150 of this embodiment, the comparison test as to the edge damage of the film has been carried out, similarly to the first embodiment. The results of comparison are shown taken in Table 2.

TABLE 2

| | Base Layer thickness | Fixing property | Shifting force at which end damage occurred (Jam clearance operation) (gf) | No. of processed sheets at which end damage occurred (fixing operation) |
|---|---|---|---|---|
| Conventional | 40 μm | E | 600 | 10,000 |
| | 50 μm | E | 1200 | 50,000 |
| | 60 μm (=Emb. 1) | G | 2000 | >100,000 |
| | 70 μm | NG | >3000 | >100,000 |

TABLE 2-continued

| | Base Layer thickness | Fixing property | Shifting force at which end damage occurred (Jam clearance operation) (gf) | No. of processed sheets at which end damage occurred (fixing operation) |
|---|---|---|---|---|
| Embodiment 1 | 40 μm | E | 1000 | 50,000 |
| | 50 μm | E | 2000 | >100,000 |
| | 60 μm (=Emb. 1) | G | >3000 | >100,000 |
| | 70 μm | NG | >3000 | >100,000 |
| Embodiment 2 | 40 μm | E | 2000 | >100,000 |
| | 50 μm | E | >3000 | >100,000 |
| | 60 μm (=Emb. 1) | G | >3000 | >100,000 |
| | 70 μm | NG | >3000 | >100,000 |

In the first embodiment, when the base layer film thickness is 40 μM, the fixing flange 130 broke the film edge at the 1000 gf, but the fixing flange 150 of this embodiment did not break the film edge until 2000 gf, as to the jam clearance operation. When the base layer film thickness is not less than 50 μm, the edge damage of the film due to the jam clearance operation did not occur.

The results of comparison regarding the film edge damage due to the long term fixing operation show that even when the thickness of the base layer of the film is 40 μm, no damage occurred until 100,000 sheets processed, which is twice the lifetime of the heating device. With the fixing flange of this embodiment, the edge damage of the film due to the jam clearance operation and long term fixing operation was suppressed when the base layer film thickness is 50 μM with which the fixing property is satisfactory.

The fixing flange 150 of this embodiment limits the shifting of the fixing film 112 in the wide regulation region (Tr) which is close to the entire area of the upstream side film inner surface guide region Jr which contacts the inner surface of the fixing film 112 and guides the fixing film 112. With such structures, the occurrence of the edge damage of the film can be further suppressed.

In this embodiment, the description has been made about the driving side fixing flange 150, but the similar structures are used in the non-driving side, and the same advantageous effects are provided. In addition, the fixing film opposing surface 150*a* of the fixing flange 150 is provided with a taper angle θ such that the downstream side clearance Lk is longer than the upstream side clearance Lj and the clearance Ls by approx. 500 μm. However, similarly to the first embodiment, the difference between the downstream side clearance Lk and the upstream side clearance Lj and the clearance Ls is not limited to this specific value, and the different can be optimized, matching the structures of the image heating apparatus.

Modified Example

In the first and second embodiments, the shifting of the fixing film is not regulated by the portion where the fixing flange does not guide the inner surface of the fixing film in the downstream side of the center portion of the nip with respect to the feeding direction of the recording material. And, the taper angle θ is provided on the opposing surface opposing to the edge of the fixing film of the fixing flange so as to be away from the end edge of the fixing film 112 as the distance toward the downstream side from the upstream side increases with respect to the recording material feeding direction, but this is not restrictive to the present invention. A further embodiment will be described.

Figure 8:
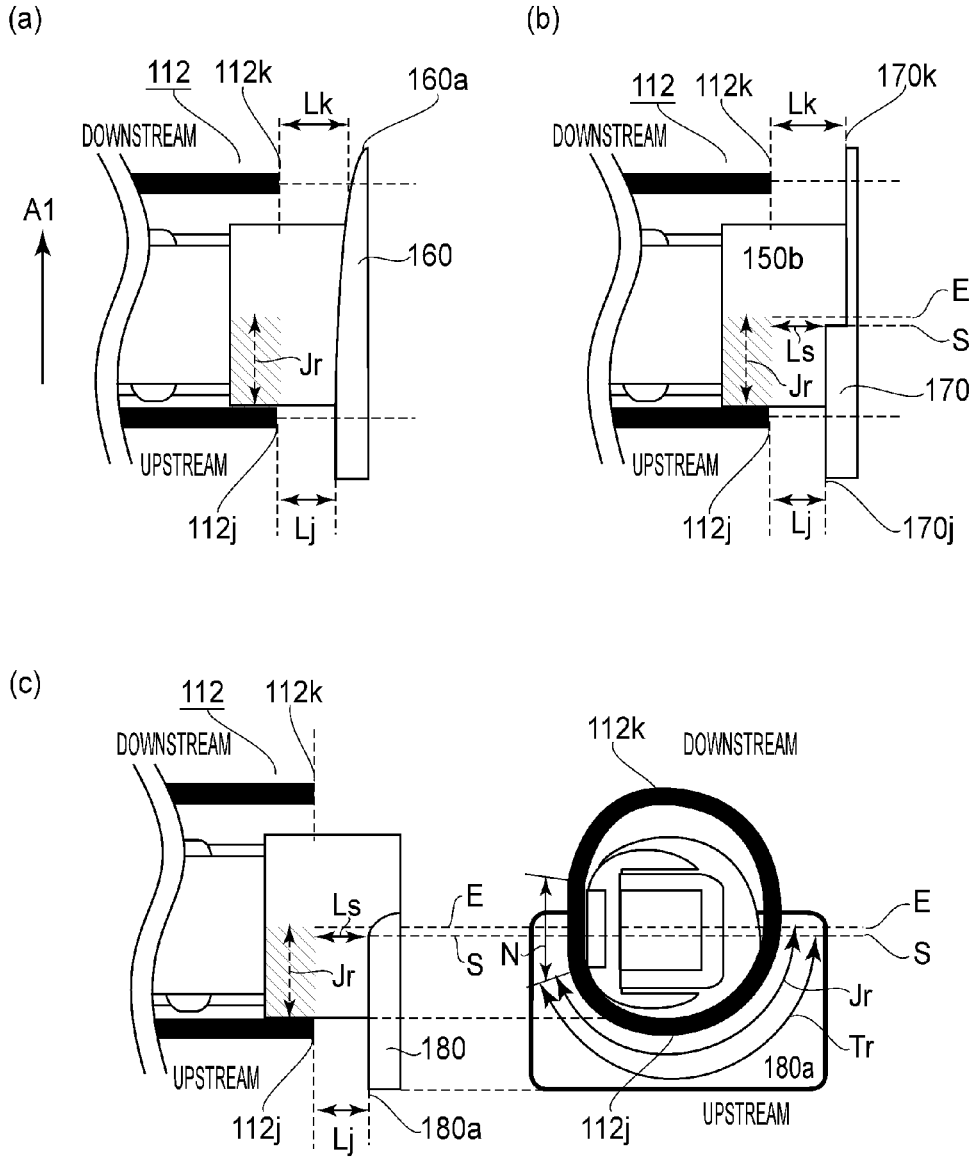
FIG. 8 are enlarged views of a fixing flange portion according to a further embodiment of the present invention.

1) Fixing Flange Structure:

FIG. 8 is a schematic view illustrating a structure of a fixing flange according to a further embodiment. As shown in part (a) of FIG. 8, for example, an opposing surface 160*a* of a fixing flange 160 is provided with an offset region which is curved. As described above, as to the clearance between the edge of the fixing film 112 and the opposing surface 160*a* of the fixing flange, the fixing flange regulation surface 160*a* is curved such that the clearance Lk in the downstream side of the center portion with respect to the recording material feeding direction is larger than the upstream side clearance. With this structure, the same advantageous effects are provided.

A fixing flange 170 of the part (b) of FIG. 8 is provided with a step between a surface 170*j* to which the end portion of the fixing film 112 abuts in the upstream side and the downstream side surface 170*k*. With such a structure, as to the clearance between the edge of the fixing film 112 and the fixing flange regulation surface, the clearance Lk in the downstream side of the center portion of the nip with the recording material feeding direction is larger from the clearance in the upstream side thereof, by the provision of the step. With this structure, the same advantageous effects are provided. In addition, as shown in part (c) of FIG. 8, the opposing surface of a fixing flange 180 opposing the downstream side of the center portion of the nip with the recording material feeding direction of the fixing film 112 does not exist.

The surface (offset region) receiving the fixing film 112 in the downstream side may be omitted.

It will suffice if the shifting of the fixing film 112 in the longitudinal direction is limited in the upstream side film inner surface guide region Jr which guides the inner surface of the fixing film 112 in the upstream side. By this, the edge damage of the film in the downstream side does not easily occur.

In the foregoing, the structures of the regulating members are the same, but the above-described structures may be employed only on the driving side end.

Figure 9:
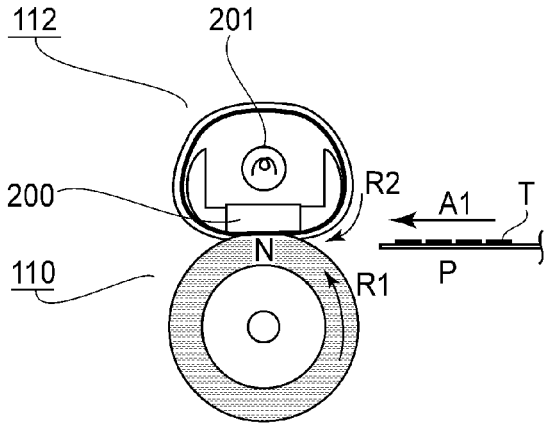
FIG. 9 is a schematic sectional view of a different image heating apparatus.

2) Structure of Image Heating Apparatus Other than Fixing Flange:

In the first and second embodiments, the rotatable members, the heating members and the pressing members have the same structures, but they are not restrictive to the present invention. For example, as shown in FIG. 9, the heating member may comprise the fixing film 112 and a halogen heater 201 therein in which a fixing nip N is formed by a sliding member 200 and a pressing roller 110.

The fixing film (rotatable member) has been described as having a base layer 126 and a parting layer 127 (2 layer structure), but this is not inevitable, and elastic layer may be provided between the base layer 126 and the parting layer 127.

By using a heat resistive silicone rubber or the like as the elastic layer, the fixing film can be close-contacted to the unsmooth surface of the recording material, and therefore, the image quality is improved. The close-contactness is better when it is large, but if it is too thick, the heat transfer from the heater to the recording material is obstructed with the result of poor fixing property, and therefore, it is preferably approx. 30 μm-300 μm. Also in the case that the fixing film having the elastic layer is used, the longitudinal shifting the fixing film 112 can be regulated in the region of the portion Jr where the inner surface of the fixing film 112 in the upstream side is guided. By doing so, the edge damage of the film does not easily occur, the similar advantageous effects can be provided.

As for the heating member, in place of the heater press-contacted to the inside of the endless belt, an electromagnetic induction heating means (excitation coil and magnetic flux core) may be used, or a resistance layer may be provided inside the endless belt (self-heat-generation) supplied with electric power. In the former case, the endless belt is made of ferromagnetic metal (having a high magnetic permeability) such as iron, and eddy currents are generated in the endless belt by the outside excitation coil and the inside magnetic flux core. In the latter case, the electric power is supplied through electrodes to generate the heat in the belt. In such a case, the back-up member may replace the heater in the foregoing embodiments.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 125126/2011 filed Jun. 3, 2011 which is hereby incorporated by reference.

What is claimed is:

1. An image fixing apparatus for fixing a toner image on a recording material by heating the toner image while feeding the recording material through a nip, said apparatus comprising:

a cylindrical film;

a nip forming member contacting an inner surface of said film;

a pressing rotatable member forming the nip in cooperation with the nip forming member with said film interposed therebetween; and a regulating member configured to regulate movement of said film, wherein said regulating member has a first surface opposing an end surface of said film in a generatrix direction of said film and a second surface opposing the inner surface of said film at an end portion of said film in the generatrix direction, wherein the first surface has a regulation region contactable by the end surface of said film when said film moves in the generatrix direction, and wherein the regulation region is formed by a curved surface which is curved such that the regulation region is narrower in a downstream side of a center portion of the nip than in an upstream side thereof with respect to a feeding direction of the recording material.

2. An apparatus according to claim 1, wherein said regulating member regulates movement of said film in a radial direction.

3. An apparatus according to claim 1, wherein the first surface has an offset region in the downstream side of the center portion of the nip, the offset region being farther away from the end surface of the film in the generatrix direction than the regulation region.

4. An apparatus according to claim 1, wherein the distance between the first surface and the end surface of said film increases from the upstream side to the downstream side with respect to the feeding direction of the recording material.

5. An apparatus according to claim 1, wherein a surface in the regulation region is parallel with the end surface of said film.

6. An apparatus according to claim 1, wherein said nip forming member includes a heater.

7. An apparatus according to claim 1, further comprising a heater, surrounded by said film, configured to heat an inner surface of said film.

8. An apparatus according to claim 3, wherein a surface in the regulation region and a surface in the offset region are parallel with each other.

9. An image fixing apparatus for fixing the toner image on a recording material by heating the toner image while feeding the recording material through a nip, said apparatus comprising:

a cylindrical film;

a nip forming member contacting an inner surface of said film;

a pressing rotatable member forming the nip in cooperation with the nip forming member with said film interposed therebetween; and a regulating member, wherein said regulating member has a first surface opposing an end surface of said film in a generatrix direction of said film and a second surface opposing the inner surface of said film at an end portion of said film in the generatrix direction, and wherein the first surface has a regulation region contactable by the end surface of said film when said film moves in the generatrix direction, the regulation region being formed only in an upstream side of a center portion of the nip with respect to a feeding direction.

10. An image fixing apparatus for fixing the toner image on a recording material by heating the toner image while feeding the recording material through a nip, said apparatus comprising:

a cylindrical film;

a nip forming member contacting an inner surface of said film;

a pressing rotatable member forming the nip in cooperation with the nip forming member with said film interposed therebetween; and a regulating member configured to regulate movement of said film, wherein said regulating member has a first surface opposing an end surface of said film in a generatrix direction of said film and a second surface opposing the inner surface of said film at an end portion of said film in the generatrix direction, wherein the first surface has a regulation region contactable by the end surface of said film when said film moves in the generatrix direction, wherein the regulation region is narrower along the entire downstream side of a center portion of the nip than in an upstream side thereof with respect to a feeding direction of the recording material, and wherein the regulation region at the upstream side comprises a surface parallel with the end surface of said film while the end surface of said film contacts the first surface of said regulation member.

11. An apparatus according to claim 10, wherein the nip forming member is a heater.

* * * * *